US005458231A

United States Patent [19]

Belokin et al.

[11] Patent Number: 5,458,231

[45] Date of Patent: Oct. 17, 1995

[54] DISPLAY AND SHIPPING PACKAGE

[76] Inventors: Paul Belokin; Martin P. Belokin, both of P.O. Box 1907, Denton, Tex. 76202; Norman P. Belokin, 3341 Evers Pkwy., Denton, Tex. 76207

[21] Appl. No.: 233,449

[22] Filed: Apr. 26, 1994

[51] Int. Cl.[6] ..... B65D 5/50; B65D 73/00

[52] U.S. Cl. ..... 206/45.14; 206/460; 206/472; 229/103.2

[58] Field of Search ..... 206/460, 526, 206/457, 472, 474, 45.14, 44 R; 229/103.2, 115; 294/141, 143

[56] References Cited

U.S. PATENT DOCUMENTS

| | | | |
|---|---|---|---|
| 313,100 | 3/1885 | Oliver | 206/472 |
| 2,007,088 | 7/1935 | Jones | 229/103.2 |
| 2,195,577 | 4/1940 | Miles | 206/460 |
| 2,676,704 | 4/1954 | Marks | 206/460 |
| 3,645,281 | 2/1972 | Seidler | 206/460 X |
| 4,209,091 | 6/1980 | Lieberman | 206/460 X |
| 4,925,029 | 5/1990 | Friedman et al. | 206/473 |

FOREIGN PATENT DOCUMENTS

| | | | |
|---|---|---|---|
| 0192843 | 11/1957 | Germany | 206/460 |

*Primary Examiner*—Bryon P. Gehman
*Attorney, Agent, or Firm*—Jack A. Kanz

[57] ABSTRACT

Display and handling packages for use in protecting delicate three-dimensional stickers during transportation and display are formed by a longitudinal rib having spaced patches of silicon on which the three-dimensional stickers are mounted and two folding sides having a reflective surface thereon extending from the rib which cover and protect the stickers mounted on the rib during transportation and which open for exhibit of the stickers when the package is on display.

12 Claims, 2 Drawing Sheets

DISPLAY AND SHIPPING PACKAGE

This invention relates to display and shipping packages for fragile products. More particularly, it relates to unitary folding support structures and the like which support and protect fragile products during shipping and handling and which can be used as attractive display media without removing the fragile products.

Stickers of all shapes and sizes are enjoying a great success in today's marketplace. Stickers have been traditionally two dimensional, with surface designs varying from cartoon characters to color-your-own patterns. Spin-offs from the sticker craze vary from three dimensional renditions of insects having wings, antennae, etc., projecting from the sticker base to holograms of dinosaurs or the like. Three dimensional stickers, such as the butterflies illustrated in the accompanying drawing, are sometimes delicate and require special handling and packaging.

Problems arise when packaging three dimensional stickers because they are so easily damaged during handling and transportation. Damaged goods translate to lost revenues and potential market failure. Accordingly, shopkeepers may choose not to carry goods which are frequently damaged or may price them out of the market. There is, therefore, a need for packaging which protects delicate stickers from damage during transportation and handling and, at the same time, provides for an effective display of the stickers.

In accordance with the present invention, a display and handling package is provided which comprises a center rib spine and two sides extending from the rib defining a foldable longitudinal container having a display position configuration and a handling position configuration. The display configuration consists of the two sides lying in substantially the same plane as a front face of the center rib which define an inner surface of the package. The handling configuration consists of the two sides in substantially parallel positions extending substantially normal relative to the front face of the central rib. When so folded, the two sides form an enclosure around the stickers positioned therein, protecting the delicate three-dimensional projections from the sticker base. To maintain a folded position, the two sides are provided with intermittently spaced connectors. The stickers are removeably attached to the surface of the front face of the center rib. Projections from the sticker base fold in substantially normal positions relative to the sticker base when the package is in its handling configuration. The two sides extending from the rib carry a reflective treatment on the package inner surface for dramatic display of the stickers when the two sides are unfolded into the display configuration. To reduce the loss of adhesive from the stickers' backs, the rib front face surface is provided with intermittently spaced patches of release material.

The accompanying drawing is incorporated into and forms part of the specification to illustrate several examples of the invention. The drawing is only illustrative of preferred and alternative examples and is not to be construed as limiting the invention in any way. Various advantages and features will become more readily understood from the following detailed description taken in connection with the appended claims and attached drawing in which:

Presently preferred embodiments of the invention are described herein by reference to various examples of how the invention can be made and used. Like reference numerals are used throughout the description and the several views of the drawing to indicate like or corresponding parts.

Figure 1:
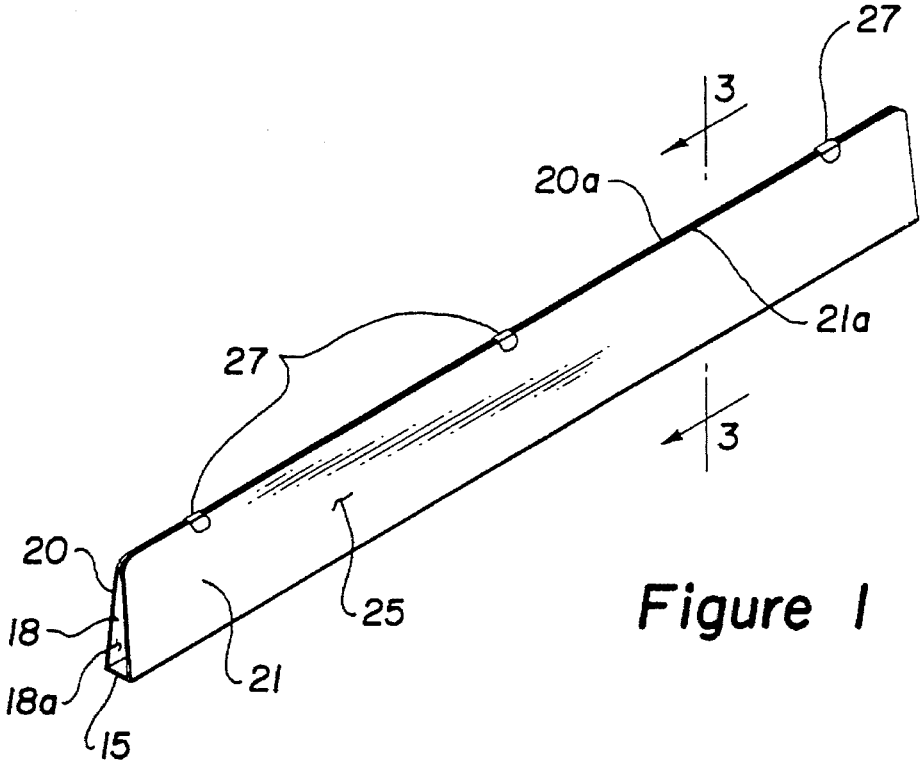
FIG. 1 is a perspective view of a presently preferred embodiment of the display and handling package of the present invention in the closed configuration.
Figure 3:
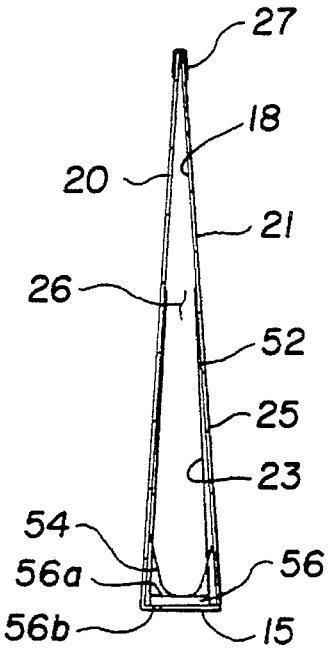
FIG. 3 is a cross-sectional view of the display package of FIG. 1 taken along line 3—3.
Figure 2:
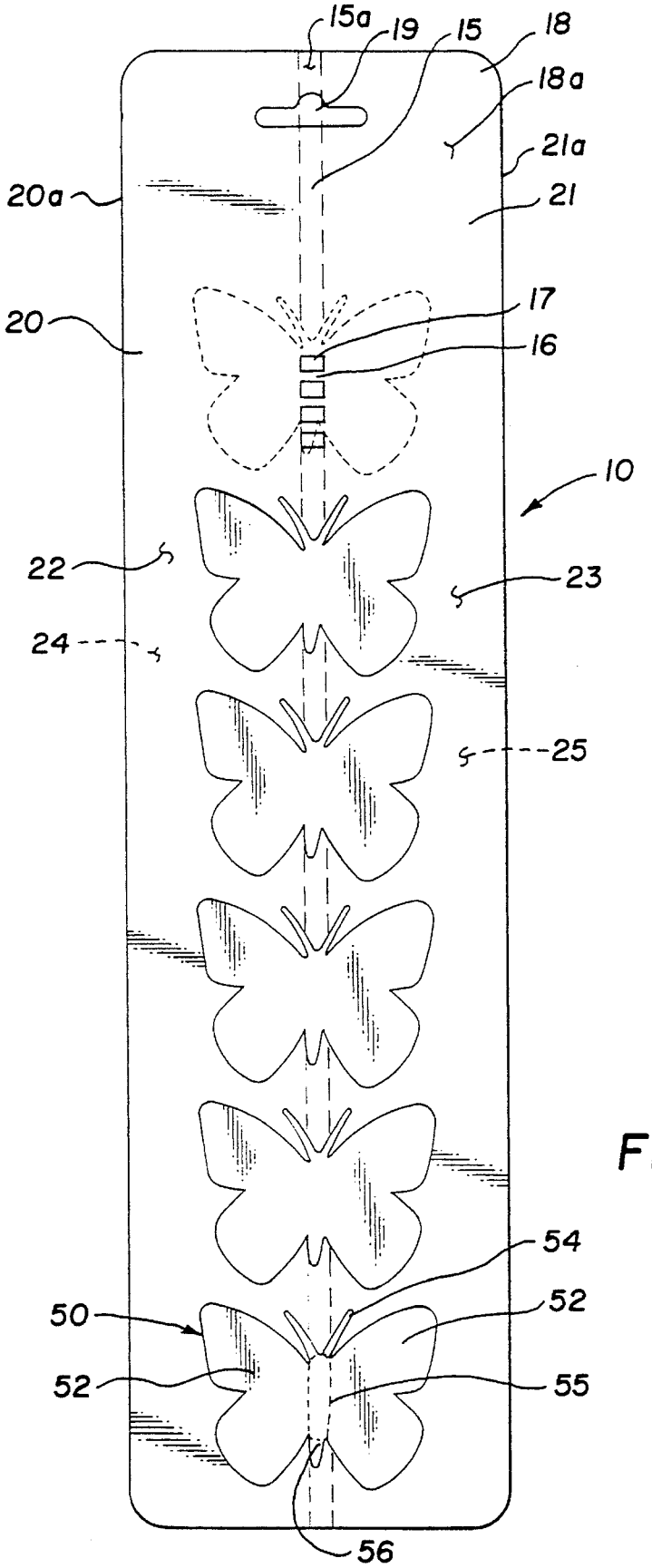
FIG. 2 is a top plan view of the display package of FIG. 1 shown in the open configuration.

FIGS. 1–3 illustrate an embodiment of the invention wherein the display and handling package 10 comprises two cover sides 20, 21 extending from a longitudinally extending rib spine 15 having a front display face 15*a* with spaced locations 16 on which a plurality of delicate stickers 50 are mounted. Cover sides 20 and 21 have inner display faces 22 and 23 and outer protective faces 24 and 25.

Each sticker 50 illustrated in the drawings is a three-dimensional rendition of a butterfly comprising a pair of wings 52, antennae 54 and a body 56. Body 56 includes a top side 56*a* and an underside 56*b* . Underside 56*b* is provided with adhesive for mounting butterfly 50 on most surfaces. The width of rib 15 depends on the width of the sticker body 56. The length of package 10 depends on the length and number of stickers in a package but is limited by desired stiffness and manageability of package 10.

Spaced patches 17 of a suitable release material such as a coating of silicone are provided on the rib front face 15*a* to reduce the loss of adhesive during mounting and removal of butterflies 50 from package 10. Silicone fluid and emulsions can be used as release materials by coating a surface with the silicone. Patches 17 are spaced so that intermittent patches of an attachable surface 16 are provided therebetween to which butterflies 50 are removeably attached.

Inner surface 18 of package 10 defined by front display faces 22, 23 and 15*a* is preferably provided with a display media such as a layer of a reflective material 18*a* or the like which provides a dramatic exhibit of butterflies 50. When sides 20 and 21 are lying flat in substantially the same plane as front display face 15*a* of center rib 15 and in a display position, the undersides of the butterfly wings 52 are illuminated and displayed by reflection of light from reflective material 18*a*. During transportation, however, sides 20 and 21 are in an upwardly extending protective handling position as shown in FIGS. 1 and 3. The display faces 22, 23 and 15*a* thus face inwardly. When sides 20 and 21 are in the protective position, butterfly wings 52 and antennae 54 also extend upwards, folding about edge 55 on butterfly body 56. A plurality of fastener means 27 (such a tape or velcro patches) are provided along the edges 20*a* and 21*a* of sides 20 and 21 to secure edge 20*a* to edge 21*a* and form an enclosure 26 around butterflies 50.

Even though numerous characteristics and advantages of the present invention have been set forth in the foregoing description together with details of the structure and function of the invention, the disclosure is illustrative only. Various changes may be made in detail, especially in matters of shape, size and arrangement of the parts, and remain within the principles of the invention to the full extent indicated by the broad general meaning of the terms used. The restrictive description and drawing of the specific examples above are intended to provide at least one explanation of how to make and use the invention. The limits of the invention and the bounds of the patent protection are measured by and defined in the appended claims.

What is claimed:

1. A display and handling package comprising:

(a) a longitudinally extending rib having a front face and a plurality of spaced patches of release material on said front face;

(b) two sides extending from said rib, each side having a front display face and a display position wherein said sides lie in substantially the same plane as said rib front face and a handling position wherein said sides extend upwardly from said rib front face forming an enclosure therebetween; and (c) means for securing said sides in said handling position.

2. A display and handling package as defined in claim 1 wherein said front display face on each of said two sides has a reflective surface.

3. A display and handling package as defined in claim 1 wherein said release material is silicone.

4. A display and handling package comprising:

(a) a spine having a front face and a plurality of spaced patches of release material;

(b) two sides extending from said spine forming a protective cover having a display surface, said display surface provided with a reflective treatment;

(c) a display position wherein said sides lie in the same plane as said spine front face and a handling position wherein said two sides extend upwardly from said spine front face forming an enclosure therebetween; and (d) means to secure said sides in said handling position.

5. A display and handling package as defined in claim 4 wherein said release material is a coating of silicone.

6. A butterfly sticker display and handling package comprising:

(a) a longitudinally extending rib having a front face and a plurality of spaced patches of release material thereon;

(b) a plurality of stickers mounted on said rib, each sticker having a base defining a simulated butterfly body with a pair of wings and antennae projecting from said body and having an adhesive back for mounting said sticker;

(c) two sides extending from said rib, each side having a front display face and a display position wherein said sides lie in substantially the same plane as said rib front face and a handling position wherein said sides extend upwardly from said rib front face forming an enclosure therebetween protecting said stickers; and (d) means for securing said two sides in said handling position.

7. A display and handling package as defined in claim 6 wherein said front display face on each of said two sides has a reflective surface.

8. A display and handling package as defined in claim 7 wherein said release material is silicone.

9. A shipping and display support comprising:

(a) a substantially rigid flat surface support sheet having first and second oppositely disposed major faces;

(b) a pair of fold lines formed in said first major face defining a relatively narrow support base therebetween;

(c) fastening means for securing together the edges of said first major face on opposite sides of said fold lines when said support sheet is folded along said fold lines to form a cavity defined by said first major face of said support sheet;

(d) a plurality of spaced patches of release material on said support base; and (e) display media displayed on said first major face.

10. A shipping and display support as defined in claim 9 wherein said release material is silicone.

11. A shipping and display support as described in claim 9 wherein said display media includes a reflective surface.

12. A display and handling package comprising:

(a) a longitudinally extending rib having a front face with a plurality of spaced patches of release material thereon;

(b) two sides extending from said rib, each side having a front display face with a reflective surface and having a display position wherein said sides lie in substantially the same plane as said rib front face and a handling position wherein said sides extend upwardly from said rib front face forming an enclosure between said sides; and (c) means for securing said sides in said handling position.

* * * * *